US005106017A

United States Patent [19]

Hicks

[11] Patent Number: 5,106,017

[45] Date of Patent: Apr. 21, 1992

[54] PNEUMATIC FILM PUNCH

[76] Inventor: Ray Hicks, 2605 Corunna Rd., Flint, Mich. 48503

[21] Appl. No.: 657,713

[22] Filed: Feb. 19, 1991

[51] Int. Cl.[5] ..... B26F 1/04

[52] U.S. Cl. ..... 234/1; 234/107; 83/13; 83/571; 83/639.5

[58] Field of Search ..... 83/571, 618, 620, 639.1, 83/639.5, 691, 13; 234/107, DIG. 1, 1

[56] References Cited

U.S. PATENT DOCUMENTS

| | | | |
|---|---|---|---|
| 3,176,569 | 4/1965 | Daniels | 83/639.5 X |
| 3,299,761 | 1/1967 | Goldman | 83/639.5 |
| 3,350,003 | 10/1967 | Jackowski | 234/107 |
| 4,000,673 | 1/1977 | Lyon | 83/571 X |
| 4,623,089 | 11/1986 | Scott | 83/571 X |
| 4,685,613 | 8/1987 | Schambre | 234/107 X |
| 4,976,179 | 12/1990 | Lacrouts-Cazenave | 83/571 X |

*Primary Examiner*—Douglas D. Watts
*Assistant Examiner*—Eugenia A. Jones
*Attorney, Agent, or Firm*—Krass & Young

[57] ABSTRACT

The invention is an improvement to punches for placing one or more openings on the edge of a sheet of material. A collection of individual punch pins are carried within bores in a punch block. Movement of the pins is constrained by a corresponding collection of pneumatic actuators. The constrained pins are driven against a die block to affect the punching operation. To insure that the punch pins do not interfere with the operation of the pneumatic actuators between machine cycles, a fixed retraction guide cooperates with a relieved section on each punch pin to position each pin at one extremity of the bore within which the actuator travels.

7 Claims, 2 Drawing Sheets

PNEUMATIC FILM PUNCH

FIELD OF THE INVENTION

The invention falls within the general category of punching tools, and can be classified more specifically as an improved pneumatically-operated punch for placing marking holes in the edge of a strip of photographic film.

BACKGROUND OF THE INVENTION

Modern, large volume commercial photographic laboratories process exposed photographic film in an automated assembly line environment. Usually, several rolls of exposed photographic film are spliced into a single continuous strip for development and printing. Efficient management of the automated photo processing environment requires correlation of each negative frame with each print, and with stored electronic data regarding each photographic subject.

To facilitate this correlation, it is now common practice to physically mark the edge of each individual photographic negative frame by punching one or more small holes in the film edge. In the simplest case, a single punched hole may be made in the film edge between exposures to designate the separation point between the two exposures. Such a mark may be detected by a suitable sensor as the film is transported through an automated printer, for example, to initiate a series of machine based instructions in the printer. In this fashion, the printer may use the signal generated by such a sensor to (1) advance the strip of film through the optical stage of the printer, (2) advance an associated roll of photographic paper, (3) illuminate an exposure lamp and (4) activate the printer shutter.

Under other circumstances, it is desirable to provide positive identification of each negative frame by providing each negative frame with a discrete identifying code. Using a hole punch, the edge of each frame of film can be encoded with a pattern of machine readable holes, e.g., in binary-coded decimal (BCD) format. This discrete identifying data is readily correlated to other data regarding each negative frame. This other data may take the form of a computer data record which is stored, sorted, retrieved, utilized and edited simultaneously with the processing of the film. An example: a photographer takes a photo of a series of human subjects as part of a single photographing job. Midway through the job, one of the subjects blinks his eyes just as the camera shutter is closed. The photographer makes a second exposure of that subject, and identifies the first exposure as a "blink", in his processing notes. If each negative frame can be positively identified by edge marking, the photographer can instruct the lab not to make prints of the "blink" frame. This information is commonly stored in a computer data base organized by frame identifier. The film edge punch code is easily correlated to the data base to provide automated control over many similar aspects of the photo processing activity.

A variety of methods for punching the film edge have been developed. The best devices currently known comprise a collection of small individual punch pins co-located in a unitary punch block. An associated die block contains a series of die openings adapted to receive the punch pins. The punch pins are spring biased and slidably mounted within the punch block by a plurality of pneumatic actuators. When any individual actuator extends, a plunger pushes on the associated pin. When the punch block and die block are forced together, each such extended pin protrudes from the punch block and into the die block. A film edge placed between the two blocks will be punched, accordingly, with a pattern of holes corresponding to the pattern of constrained pins.

As the punch and die blocks are separated, the pneumatic actuators also retract, allowing the pins in the punch block to return to the retracted position under the influence of the spring biasing means. Frequently, however, uneven pin wear characteristics, slugs generated from the punching process, or bias spring fatigue cause the pin to remain in the extended position, impeding the movement or removal of the photographic film from the die and punch blocks. This, in turn, impedes further movement of the film through the punching station.

SUMMARY OF THE INVENTION

The present invention overcomes each of the above limitations. To improve upon the current style of die block, the present invention substitutes a fixed pin retractor block for the biasing spring. Each punch pin is provided relieved surface along the longitudinal axis to define the travel of the punch within the block. A retaining block abuts the flattened portion of each punch pin. The flattened portion is dimensioned to permit limited travel of the pin between defined retraction and extension positions in relation to the punch and die blocks.

DESCRIPTION OF THE PREFERRED EMBODIMENT

Figure 1:
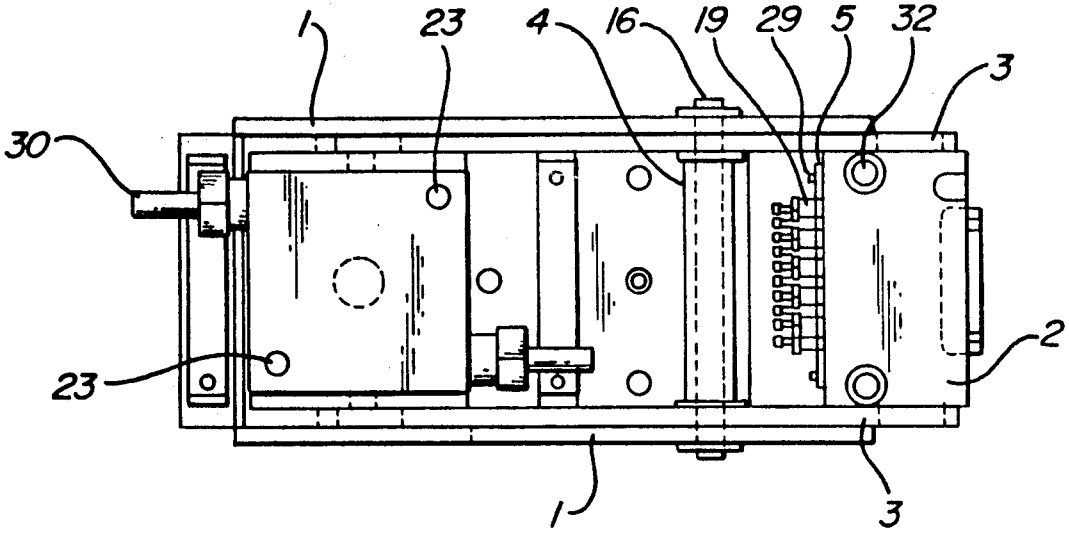
FIG. 1 is a top view of a punch assembly incorporating the invention.
Figure 2:
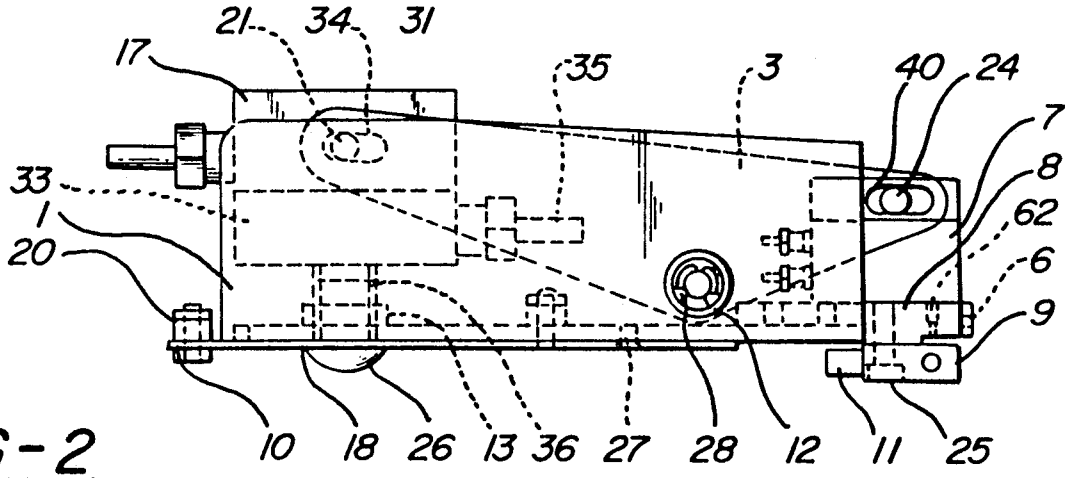
FIG. 2 is a side view of a punch assembly incorporating the invention.
Figure 3:
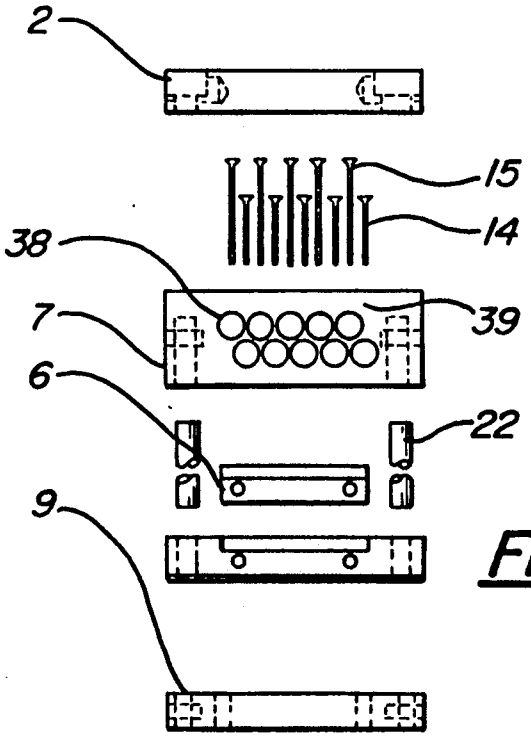
FIG. 3 is a front exploded view showing the bit selector block, punches and associated components.

The assembly and operation of the invention will be best understood by simultaneous reference to FIGS. 1, 2 and 3. The various punch components are attached to a weldment 1, which is preferably mounted to a photographic processing station by fasteners 20. The invention is preferably used in conjunction with a pneumatic actuator in the form of an air cylinder 33. The piston of Said air cylinder 33 is attached by screws 23 to mounting, block 17, which in turn is secured to the punch channel weldment 1 utilizing a washer 18, a spacer 13 and a screw 26. The body of the air cylinder 33 is pivotably mounted to linkage arms 3 by means of a pair of pivot block pins 21, which engage linkage arm openings 34. Suitable spacing of the punch assembly on the surface to which it is mounted is achieved by the application of one or more punch block shims 10 utilizing shim fastening screws 31 and 27. Linkage arms 3 are provided with a central pivot shaft 16 and pivot bushings 12. Two linkage arms 3 are disposed on opposing sides of the air cylinder 33, and spaced apart by linkage arm, spacer 4. Pivot shaft retainer circle clips 28 retain the two linkage arms 3, the pivot shaft 16 and pivot shaft bushings 12 in place in relation to the opposing sides of the weldment 1. Weldment 1 takes the form of an elongated U-shaped channel bracket and is preferably formed from anodized aluminum which may be either welded or extruded. Air cylinder 33 is equipped with air inlet 30 and air outlet 35. The air cylinder 33 is actuated by selectively applying pressure to air inlet 30, and selectively permitting exhaust from air outlet 35. Pressurization of the air cylinder causes air cylinder piston 36 to push outward from the cylinder body, thereby rotating one end of linkage arms 3 upward and away from the base of weldment 1. The punch assembly is disposed at the opposing end of linkage arms 3. With reference now to FIG. 3, it will be seen that a plurality of individual punches 14 and 15 are slidably placed within a corresponding plurality of bores 39 formed in the bit selector block 7. To conserve space, the punches are divided into a first set of long punches 15 and a second set of short punches 14. A plurality of throughbores 38 intersect the punch bores 39 at right angles thereto. As shown in the left-most throughbores 38 of FIG. 4, the bottom one-fourth of the circumference of each said throughbore is relieved 60 to permit the head of each corresponding punches 14 and 15 to rest at or below the outer circumference of each said throughbore 38. The punches 14 and 15, when inserted in the bit selector block 7, are retained by pivot block 2, which is secured to bit selector block 7 by screws 32. Pivot block 2 is provided with dowel pins 24 which engage second pivot points 40 disposed at the end of linkage arms 3 opposite the air cylinder 33 end of said linkage arms 3. Punch guide block 8 and die block 9 are secured to the end of weldment 1 by suitable fasteners 25. The punches are inserted in an array of guide holes 62 in punch guide block 8. A corresponding array of die holes is located in die block 9.

Bit selector block 7 is equipped with a plurality of punch air cylinders 19. Each said air cylinder comprises a cylinder, a piston, an actuating rod cap and an air passageway. Air cylinder retainer bar 5 engages air cylinders 19 to secure said cylinders within the bit selector block 7. Bar cap screws 29 secure the bar 5 to selector block 7. Actuation of such air cylinder assembly results in extension of the piston, rod and cap assembly into the throughbores 38, thereby limiting the travel of the punch associated with said throughbores 38. The bit selector block 7 and the punch guide block 8 are maintained in alignment by a pair of guide pins 22 which are press fit to the punch guide block, and which are slidably operable in bushings pressed into bit selector block 7.

Figure 4:
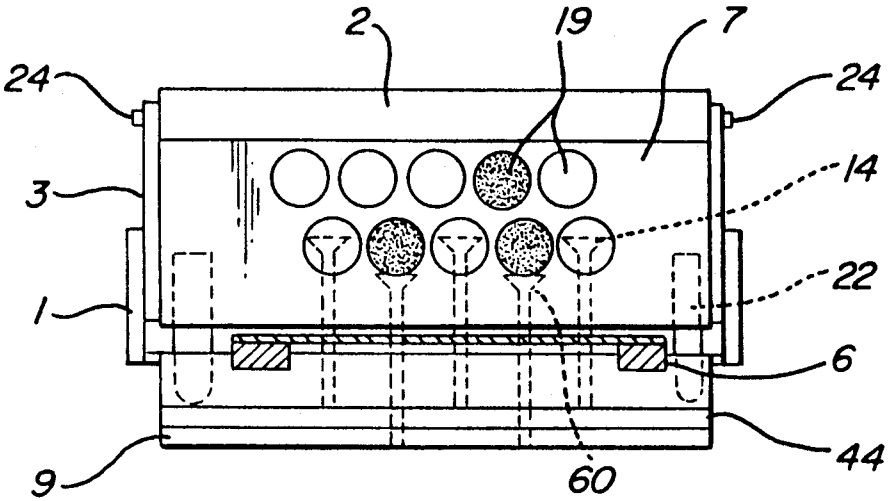
FIG. 4 is a stylized end view of the bit selector block showing the operation of the punch.
Figure 4A:
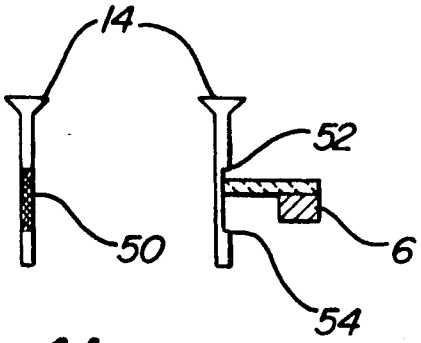
FIG. 4*a* is a detailed front view of an individual punch, and an individual punch in side view, in relation to a retaining block.

The detailed operation of the punch will be better understood by reference to FIGS. 2, 4 and 4*a*. Pivot block 2 serves to couple the pivot block and bit selector block assembly to the linkage arms 3 by virtue of dowel pins 24. Downward movement of linkage arms 3 translates into downward movement of bit selector block 7. To insure clarity, only the short punches 14 are shown. The long punches are actuated by the upper row of air cylinder assemblies 19, and pass between the lower row of throughbores 38. In this fashion, a plurality of punches may be arrayed in a straight line, while still permitting a compact configuration for the punch assembly. FIG. 4 depicts the punch assembly in the closed or "punch" position. The shaded air cylinder assembly ends 19 depict air cylinder assemblies which have been "selected" or activated, resulting in the extension of the piston rod outward from the cylinder assembly. The second and fourth assemblies of the lower array have been actuated prior to the operation of the punch. Accordingly, the punches 14 corresponding to the actuated assemblies are captured at the bottom of their respective throughbores 38. Movement of the bit selector block toward the die block 9, accordingly, has pushed two of the punches 14 through die cavity 44 into the die block 9. Any material placed within the cavity 44 would be punched with the two-hole pattern represented by the two punches 14 in the extended position. The first, third and fifth punches 14 of the lower array, however, remain in their retracted position, inasmuch as the corresponding air cylinders 19 have not been actuated. Because the punches 14 are free to float in their bores 39, each said punch will simply float upward upon meeting the resistance of photographic film placed in the cavity 44, and no punch will result.

To insure positive retraction of the punch 14 from the die block 9 and cavity 44, a punch retaining block 6 is mounted to the end of the punch guide block 8 as shown in detail in FIGS. 2 and 3, and in simplified cross-section in FIG. 4*a*. With reference particularly to FIG. 4*a*, it can be seen that each punch 14 is flattened for a portion of its overall length 50. Upper lip 52 and lower lip 54 are formed as a result of this flattening process. Punch retaining block 6 is affixed to punch guide block to engage the punch flat 50, thereby restricting the travel of each punch 14 within bit selector block 7. The usefulness of this issue will readily be seen by comparison, in FIG. 4, of the respective positions of the first, third and fifth punches of the lower throughbore array in comparison with the positions of the second and fourth punches in the lower throughbore array. As explained, FIG. 4 depicts the end of the punch at the time of the completion of the punching cycle. The second and fourth punches of the lower array have punched the material contained within cavity 44 and protrude through the die block 9. The first, third and fifth punches have not penetrated the material contained within cavity 44, and are in the fully retracted position. As the bit selector block 7 is retracted from the guide block 8 and die block 9, the second and fourth punches will tend to remain in the extended position. If the punch is oriented as shown in FIG. 4, the first, third and fifth punches will tend to drop by force of gravity to the relieved portion of the lower edge of the throughbores 38. As can be seen from the drawing, in order for the air cylinder assemblies to actuate and extend, it is essential that the punches 14 fall to their extended position in relief 60 to permit the cylinder 19 rod and rod cap assembly to protrude into the throughbores 38.

However, as the punch assembly wears, it is common for each individual punch to bind against its own punch bore. Accumulation of dust, lubricants and slugs from the punching process contributes to a deterioration in the freedom of movement of each punch. It is, accordingly, common for the already retracted punches, such as those shown in the first, third and fifth positions of the lower throughbore array, to remain in the retracted position as the punch bit selector block 7 withdraws from the punch guide block 8 and punch block 9. When this occurs, the air cylinder assembly 19 will be blocked from extension by the head of the punch 14. Pressure from the air cylinder assembly will also tend to push the head of the punch to the side, thereby binding the punch 14 in the fully retracted position. Under these circumstances, a punch pin "selected" by instructions given to the overall punch assembly will remain retracted, resulting in an erroneous punch pattern on the film.

To avoid these errors, the punch retainer block 6 is affixed to the punch guide block 8 so as to slidably engage the flat 50 on punch 14. The location and dimension of flat 50 is determined by the "throw", or range of motion of the punch assembly. In this fashion, when the bit selector block 7 is withdrawn from proximity to punch guide block 8 and die block 9, punch retaining block 6 engages flat 50 in punch 14. As punch 14 and selector block 7 move away from guide block 8, retaining block 6 engages the lower lip 54 of flat 50, thereby pulling punch 14 into the fully extended position in the relief 60 of the corresponding throughbores 38. This positive engagement of retaining block 6 and retaining lip 54 insures that the corresponding throughbores 38 will be open at the start of the punch cycle thereby allowing each air cylinder assembly 19 to extend without interference from the corresponding punch.

In operation then, the punch cycle begins, with reference to FIGS. 1 through 4, with the piston 36 of air cylinder 33 fully retracted into the body of the air cylinder. A desired hole punch pattern is selected by the controls of the photographic equipment or the operator, and transmitted to the punch in the form of pneumatic signals to the array of air cylinder assemblies 19 mounted within bit selector block 7. In the preferred embodiment, the pattern to be punched on the film edge is selected by corresponding activation of the air cylinder assemblies 19 associated with the punches 14 and 15 which will make the desired punch. As each air cylinder assemblies 19 is activated, the associated piston and rod assembly is extended from the cylinder. The rod cap of each actuated cylinder captures the corresponding punch 14 or 15 in the extended position, at the bottom of the throughbores 38 in which the air cylinder 19 assembly operates. As a result of this activation, a pattern of punches is selected and secured in preparation for punching by the punch assembly.

The end of linkage arms 3 which corresponds to pivot block pin 21 is at its closest opposition to the base of weldment 1 where weldment 1 attaches by screw 26 to the air cylinder piston. Upon actuation of the air cylinder 33, the piston 36 remains in stationary relationship to weldment 1 by virtue of the screw 26, which pushes the air cylinder away from the weldment base, thereby pivoting linkage arms 3 about pivot shaft 16.

As the air cylinder 33 moves in response to the applied air pressure, the rotation of linkage arms 3 is transmitted to pivot block 2 through the pivot block end 24. Selection of the moments between the center of pivot shaft 16, dowel 21 and end 24 results in an increased mechanical advantage at the pivot block 2. The selected punches 19 are pushed through guide block 8, cavity 44 and into die block 9, thereby placing punched holes in the media carried within the cavity 44. In the preferred embodiment, the die punch assembly is mounted along the edge of a continuously movable strip of photographic film. The photographic film passes continuously between the punches 14 and die block 9. On command, the continuous strip of film is stopped for purposes of receiving the punch from the punch assembly. After the punch has been made, the air cylinder 33 is evacuated, drawing piston 36 into the body of air cylinder 33, thereby simultaneously drawing a one end of linkage arms 3 toward the base of weldment 1 This motion is transmitted through pivot shaft 16 to pivot block 2, thereby withdrawing bit selector block 7 and the associated punches away from die block 9.

Punch retaining block 6, in contact with the flat 50 on each punch 14 or 15, engages a lip 54 in each punch 14 or 15 as the bit selector block 7 is withdrawn from the die block 9. As punch retaining block so engages lip 54, the associated punches are constrained from further movement away from the die block 9, while bit selector block 7 continues its travel. In this fashion, punches 14 and 15 are pulled into their fully extended positions in bores 39, with the head of each punch entirely within the confines of associated throughbore relief 60. In this position, the punches 14 and 15 do not impede the free travel of the air cylinder assembly rods and rod caps through throughbores 38.

Having described my invention thus, numerous improvements and modifications may be made thereto by those skilled in the art, without deviating from the essence and spirit of the invention which I claim as follows:

1. In a device for punching an opening in a sheet of material, said device having a die block, a plurality of substantially parallel punch pins slidably mounted in a corresponding plurality of punch bores in a punch block, each of said punch bores having a first open and second blocked condition, the improvement comprising:

(a) a plurality of throughbores in said punch block, one of each said throughbores communicating with one of each said punch bores;

(b) a plurality of pneumatic cylinders, each said cylinder associated with a respective one of said throughbores, and each said cylinder operable between a first extended and a second retracted position, wherein said first extended position corresponds to said first open condition and said second position corresponds to said second blocked condition;

(c) a pair of opposed stops on and defining the limit of travel of, each said punch pin;

(d) a die block having a plurality of die openings, said openings engageable with said plurality of substantially parallel punch pins; and (e) a punch retaining block fixedly secured relative to said die block, engageable with said punch pins, and limiting the travel of each said punch pin between said opposed stops.

2. In a device for punching an opening in a sheet of material, said device having a plurality of punch pins slideably mounted within a plurality of punch bores in a punch block, said punch block further having a plurality of throughbores, each of said throughbores communicating with a respective one of said punch bores for use in selecting operative punch pins of said plurality of punch pins; a die block having a plurality of die openings, said openings being engageable with said plurality of punch pins; and means for moving said punch block relative said die block, such that a sheet of material disposed therebetween will be punched by at least one operative punch pin of said plurality of punch pins as said at least one operative punch pin engages a corresponding die opening in said die block, the improvement comprising:

(a) a punch retaining block fixed relative to said die block; and (b) each of said plurality of punch pins having a stop disposed along a side thereof so as to be engageable with said punch retaining block, such that, upon relative movement of said punch block away from said die block, said punch retaining block engages said stop on said punch pins to retain said plurality of punch pins and prevent said punch pins from obstructing said throughbores.

3. The device of claim 2, wherein said stop disposed along a side of each of said plurality of punch pins is formed by a recessed flattened area in the side of said punch pins.

4. The device of claim 2, wherein said punch retaining block includes a single unitary punch retaining block adapted to engage all of said plurality of punch pins.

5. The device of claim 2, wherein said punch retaining block is fixedly secured to said die block.

6. The method of punching openings in sheets of material utilizing a device having a die block, a plurality of punch pins slidably mounted in a corresponding plurality of punch bores in a punch block, each said punch pin having a head, each said bore having a first open and a second blocked condition, comprising:

(a) selecting a first group of punch pins from said plurality of punch pins;

(b) constraining said first group of punch pins from further movement within said bores in said punch block;

(c) positioning a first sheet of material between said die block and said punch block;

(d) driving said punch block into engagement with said die block to punch at least one opening in said material;

(e) retracting said punch block from engagement with said die block; and (f) restraining said plurality of punch pins from excess movement, as said punch block is retracted from engagement with said die block, by a punch retaining block fixed relative to the die block so as to retract the heads of said plurality of punch pins to one extremity of said punch bores in said punch block.

7. The method of claim 6, wherein said method comprises the further steps of:

(a) selecting a second group of punch pins; and (b) constraining said second group of punch pins from further movement within said bores of said punch block for punching openings in a second sheet of material.

* * * * *